US007125007B2

(12) United States Patent
Wulteputte

(10) Patent No.: US 7,125,007 B2
(45) Date of Patent: Oct. 24, 2006

(54) METHOD AND APPARATUS FOR REDUCING AIR CONSUMPTION IN GAS CONDITIONING APPLICATIONS

(75) Inventor: Lieven Wulteputte, Melle (BE)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 10/606,141

(22) Filed: Jun. 25, 2003

(65) Prior Publication Data

US 2004/0262787 A1 Dec. 30, 2004

(51) Int. Cl.
*B01F 3/04* (2006.01)

(52) U.S. Cl. ..... 261/128; 261/130; 261/50.3; 261/115; 261/DIG. 9; 95/16; 96/251; 96/255

(58) Field of Classification Search ..... 261/128–130, 261/137, 50.3, 115, DIG. 3, DIG. 9, DIG. 43; 95/14, 16, 17, 19, 228; 96/251, 253, 255, 96/371, 397

See application file for complete search history.

(56) References Cited

U.S. PATENT DOCUMENTS 5,193,406 A 3/1993 Wolf et al. ..... 73/865
5,501,401 A * 3/1996 Munk ..... 239/431
5,724,824 A * 3/1998 Parsons ..... 62/171
5,791,268 A * 8/1998 Battles et al. ..... 110/345
5,890,369 A * 4/1999 Mahableshwarkar et al. . 62/121
5,922,103 A * 7/1999 Schwab et al. ..... 95/8
5,950,441 A 9/1999 Mahableshwarkar et al. . 62/171
6,293,787 B1 9/2001 Reyes ..... 432/14
6,394,119 B1 * 5/2002 Ball ..... 137/1
6,446,883 B1 * 9/2002 Huang et al. ..... 239/424.5

FOREIGN PATENT DOCUMENTS

| | | |
|---|---|---|
| EP | 1243341 | 9/2002 |
| JP | 2003106878 | 4/2003 |
| WO | WO 03/035269 | 5/2003 |

* cited by examiner

*Primary Examiner*—Scott Bushey
(74) *Attorney, Agent, or Firm*—Leydig, Voit & Mayer, Ltd.

(57) ABSTRACT

A control system for adjusting the desired air pressure provided to one or more spray nozzles disposed to receive liquid and compressed air adjusts the amount of compressed air supplied to the spray nozzle based on various sensed operating parameters of the system.

6 Claims, 5 Drawing Sheets

METHOD AND APPARATUS FOR REDUCING AIR CONSUMPTION IN GAS CONDITIONING APPLICATIONS

FIELD OF THE INVENTION

This invention generally relates to spray control systems and more particularly, to spray control systems used to monitor operating conditions in industrial gas conditioning applications and for compensating for changes in the system to optimize consumed compressed air by the system.

BACKGROUND OF THE INVENTION

Industrial production plants often generate hot or flue gases. Such flue gases must usually be cooled for proper operation of the production plant. In these applications, the flue gases are often passed through various portions of the production plant to provide a cooling effect. In other cases, however, additional cooling and conditioning systems must be utilized to produce the proper temperature. The flue gas is sometimes cooled by injecting an atomized liquid stream into the gas stream, such as through spraying water with very fine droplets into the gas stream. This operates to reduce the temperature of the gas stream.

There are typically various cooling requirements for a production plant of the general type described above. For example, the outlet temperature is typically required to be maintained at a particular temperature level or temperature set-point. Inasmuch as the flue gases typically raise the outlet temperature above the set-point value, the system is required to reduce the outlet temperature. In addition, complete evaporation of water contained within the exiting gas must be accomplished within a given distance (dwell distance). That is, all or substantially all of the liquid is required to be evaporated within a given distance of the location of the spray nozzle or nozzles to avoid undue wetting of the various components of the system. These usually include a filtration system, e.g., bag-house and other components.

For providing a liquid spray, such systems sometimes employ one or more bi-fluid nozzles. The nozzles use compressed air as an energy carrier to atomize a liquid, such as water, into fine droplets. In most systems today, the air pressure used for spray nozzles of this type is kept constant over the operating cooling range. The amount of constant air pressure required is usually calculated based on the maximum allowed droplet size for obtaining total evaporation, a parameter known to those skilled in the are as Dmax (i.e., maximum droplet size), within a given distance at the worst cooling conditions (usually at maximum inlet gas temperature and maximum inlet gas flow rate).

Of course, less liquid spray is required to cool the gas to the desired temperature when the inlet gas flow rate or inlet temperature decreases. Maintenance of a constant air pressure in these circumstances causes the air-flow rate to increase. This results in increased air consumption and in increased compressed air energy cost. For maintaining the cooling requirements of the system, it is often unnecessary to maintain the air pressure constant at lower cooling conditions. Thus, it would be desirable to closely monitor these parameters of the system to enable appropriate adjustment of air pressure provided to the atomizing spray nozzles as necessary or desired.

SUMMARY OF THE INVENTION

Accordingly, it is a general object of the invention to overcome the problems in the prior art.

It is a more specific object of the invention to provide method and system for regulating air consumption in gas conditioning applications.

It is a further object of the invention to provide a method and system for producing greater efficiency in gas conditioning applications.

This invention reduces air consumption of spray nozzles of the type used in gas cooling applications. In particular, these nozzles receive both a pressurized air supply as well as a liquid. The flow rates and pressures of the liquid and air supplied to the nozzle or nozzles are closely monitored. In this way, the air applied to the liquid atomizes the liquid at a desired droplet size. In accordance with the invention, a control system monitors the liquid flow rate of the nozzle and changes the air pressure supply to the nozzle based on the detected liquid flow rate currently used by the nozzle.

DETAILED DESCRIPTION OF THE INVENTION

The present invention generally relates to a control system that monitors various operating parameters of a spray control system for gas conditioning applications. The control system monitors the flow rate of liquid passing through a spray nozzle. The system then processes the detected flow. In response, the system provides a signal indicative of air pressure supplied to the nozzle. This achieves a reduction of the compressed air consumption and an energy savings of compressed air generation.

This invention has particular applicability to various industrial areas. These include the pulp and paper industry, waste recycling, steel fabrication, environmental control and power generation. Various applications within these general areas include flue gas cooling prior to dust collection processing stages such as bag-house dust collection devices. In addition, the invention may be employed in conjunction with nitrous oxide control such as in fossil fuel consumption and for diesel engines, and for sulfur dioxide removal in wet or dry processes.

Figure 1:
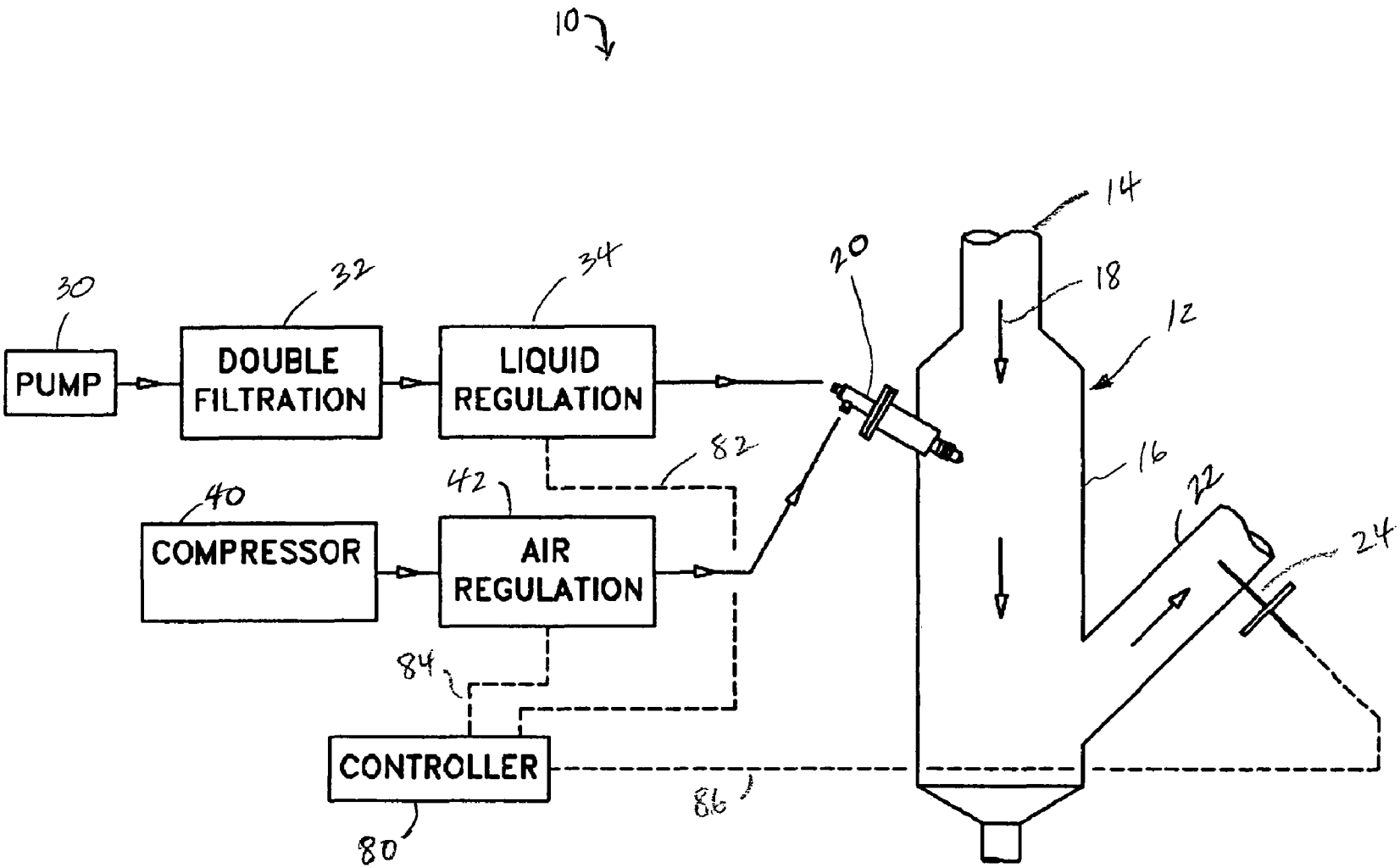
FIG. 1 is a schematic block diagram of an industrial plant and a spraying control system for monitoring the air pressure applied to a nozzle or nozzles according to the invention.

FIG. 1 illustrates one environment for implementing the present invention. As shown therein, an industrial plant 10 includes a gas conditioning system that comprise one or more conditioning towers such as conditioning tower 12 shown in FIG. 1. At its generally cylindrical inlet section 14, the conditioning tower 12 is disposed to receive hot flue gases created as part of the production process. The conditioning tower 12 includes a generally cylindrical mixing section 16, disposed downstream of the inlet section 14. The flue gases received at the inlet 14 are oriented in the general direction denoted by the arrow 18 shown in FIG. 1. One or more liquid spray nozzles such as nozzle 20 are disposed in at circumferential locations about the mixing portion 16 of the conditioning tower 12. In the illustrated embodiment, the liquid spray nozzle 18 is provided in the form of a lance and provides a liquid spray oriented in a generally downwardly directed liquid spray pattern for cooling the flue gases to a desired temperature.

The conditioning tower 12 also includes a cylindrical outlet or venting section 22. This section 22 is connected with the mixing portion 16 downstream of the spaced lances 20 and oriented at an angle with respect to the mixing portion 16. For measuring the temperature of the exiting flue gas stream, one or more temperature sensors 24 are disposed proximate the distal end of the outlet section 22. In most instances the liquid droplets have evaporated prior to reaching the outlet section 22 of the conditioning tower 12.

For providing liquid to the liquid spray nozzles 20, a liquid supply comprises a pump 30 coupled with a double filtration system 32. The filtration system 32 receives a pressurized liquid supply from the pump 30 and provides filtered liquid to a liquid regulation section 34. The regulation section 34 supplies a liquid at a desired pressure and a desired flow rate to the spray nozzles 20, as shown schematically in FIG. 1.

At the same time, a controlled air supply is also provided to the spray nozzles. As shown in FIG. 1, an air compressor 40 provides compressed air to an air regulation section 42. The air regulation section 42, in turn, supplies a regulated amount of compressed air to the spray nozzle 20. As discussed above, prior art systems provided a static amount of compressed air. This amount was applied regardless of the operating temperature of the exiting flue gases.

Figure 2:
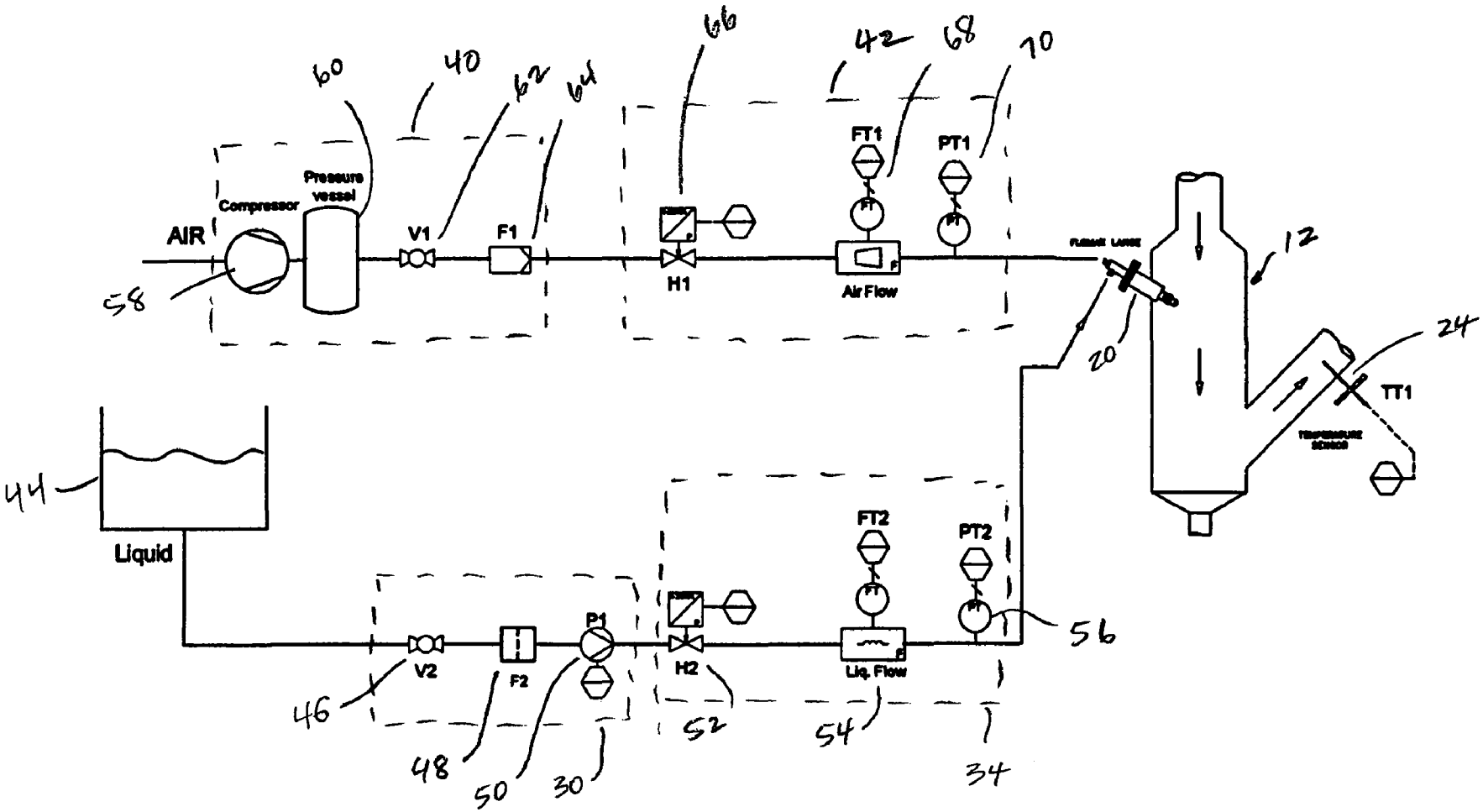
FIG. 2 is a more detailed block diagram representation of the spraying control system shown in FIG. 1.

FIG. 2 illustrates certain components of the liquid and air supply sections in one illustrated embodiment. As shown therein, a vessel 44 containing a liquid such as water supplies the liquid to the pump section 30 of the liquid supply. The pump section 30 may include an inlet valve 46. In the illustrated embodiment, the liquid passes through a liquid filter 48 to a pump 50. The pump operates to provide a pressurized liquid at its outlet.

From the pump section 30, a pressurized liquid is provided via a supply line to the liquid regulating section. In this instance, the pressurized liquid is supplied to a proportional regulating valve 52. The proportional regulating valve 52 controls the liquid supplied to the spray nozzle. The regulating valve, in turn, supplies the liquid to a liquid flow meter 54 for determining the flow rate of the liquid. A pressure sensor 56 is also disposed in the liquid supply line, as part of the regulating section, for monitoring the pressure of the liquid supplied to the spray nozzles 20.

The details of the air supply section are also shown in FIG. 2. The air supply line includes a compressor 58 for providing compressed air to a pressure vessel 60. A flow control valve 62 is disposed at the outlet of the pressure vessel 60 for permitting compressed air to exit the vessel. An air filter 64 is preferable disposed in the air supply line for reducing impurities in the compressed air line.

FIG. 2 also shows the compressed air regulating section 42 in greater detail. As shown therein, a proportional regulating valve 66 regulates the compressed air supplied to the spray nozzle 20. In addition, an air flow meter 68 measures the consumption of the spray nozzle 20. Finally, a pressure meter 70 continuously monitors the pressure of compressed air supplied to the spray nozzle 20.

For controlling the liquid spray of the spray nozzles 20, a control system is coupled with a liquid regulation section and the compressed air regulation section. In the illustrated embodiment, a spray controller 80 performs various control functions by providing output control signals in response to the receipt of input control signals. Specifically, the controller 80 is disposed to receive a sensing signal from the temperature sensor 24 via a line 86 shown in FIG. 1, indicative of the temperature measured at the conditioning tower outlet 22. The controller 80 also receives input signals from the liquid section. These include a liquid flow signal from the liquid flow meter 54 indicative of the flow rate of the liquid applied to the spray nozzle. The controller 80 also receives a pressure indicating signal from the pressure sensor 56.

In addition, the controller 80 receives various input signals from the compressed air line. Specifically, the controller 80 receives an air-flow rate signal from the air flow meter 68. Similarly, the controller 80 receives a sensing signal from the pressure sensor 70 associated with the air-flow line.

As explained in greater below, the controller 80 operates in a logical fashion to process these signals. The controller 80 then provides output signals to the liquid regulation section 34 as denoted by the line 82. This signal is applied to the proportional regulating valve 52 shown in FIG. 2 for controlling the liquid flow to the spray nozzle 20. In addition, the controller 80 provides an output signal to control the compressed air supply, as denoted by a line 84 coupled with the air regulation section 42 in FIG. 1. That is, the controller 80 supplies a control signal to the proportional regulating valve 66 (see FIG. 2) to control the amount of compressed air provided to the nozzle 20. As explained below, regulation of the liquid and air systems in this manner maintains the desired outlet temperature as well as the total evaporation of the liquid droplets.

In accordance with the invention, the control system determines the relation between the liquid flow rate and air pressure depends on the inlet gas conditions of the process and the maximum allowed droplet size (Dmax) for obtaining complete evaporation. Typically, this relation is determined at minimum, normal and maximum process conditions. The controller 80 uses interpolation techniques when operating within these conditions for providing various output signals, as explained below. Known gas-cooling systems typically used a constant air pressure, based on the worst-case gas cooling conditions. The air pressure was maintained at a constant value even when the system was not operating at worst case cooling conditions. This sometimes resulted in unnecessary air pressure consumption by the system.

In keeping with the invention, the air pressure is changed in accordance with changing gas cooling conditions. These may be the result of changing inlet gas temperature or of the flue gas flow rate. In this way, the system consumes only the required amount of air necessary for the given circumstances. The different possible process conditions are known by the system in advance. This information is used to calculate a table relation between required air pressure and liquid flow rate.

In accordance with the present invention, the air pressure is reduced when the system operates at reduced cooling conditions inasmuch as there is less gas that is required to be cooled by the system. This is performed in such a way that complete or substantially complete evaporation of the liquid droplets over the same distance is maintained. This results in a reduction of the compressed air consumption and in an energy saving of compressed air generation. The specific amount of energy that can be saved depends on the process itself.

The amount of decrease in compressed air is dependent on the relationship of inlet temperature and flue gas flow rate.

For example, when the inlet temperature remains constant, and only the actual gas flow rate reduces when the process operates at reduced conditions, then the gas velocity in the processing tower 12 is reduced. When the gas velocity is reduced, the liquid droplets have increased time to evaporate. If the inlet temperature remains constant, the droplet size of the liquid spray may be increased to obtain full evaporation over the same dwell distance. This results in substantially less compressed air consumption by the system.

For implementing the control system of the invention, several variations may be employed. For example, the control scheme may be made more reliable with the use of multiple pumps instead of a single pump 50. In addition, multiple filters may be employed rather than single liquid and air filters 48 and 64. In addition, safety bypasses can be added to guarantee a safety supply of liquid and air to the nozzle when sensors or regulating valves in the illustrated flow lines fail.

For implementing the invention, various control algorithms can be used. In accordance with one preferred embodiment, the control algorithms for controlling the regulating valves 52 and 66 are as follows:

The valve position of the proportional regulating valve 52 for the liquid supply is controlled in accordance with a PID control algorithm based on the measured outlet temperature by the temperature sensor 24 and the required set-point temperature. The set-point temperature is usually a constant value.

$$m = K_p \cdot \left(e + \frac{1}{K_i} \cdot \int e\,dt + K_d \cdot \frac{de}{dt}\right)$$

With m: the position of the valve of the regulating valve 52 (0 . . . 100%), e: the temperature difference between measured temperature and set point temperature, and Kp, Ki and Kd the proportional, integral and differential factors.

A PID control algorithm controls the valve position of the compressed air regulating valve 66. While various algorithms may be used, the input parameters are based on the measured air pressure by the pressure sensor 70 and the required air pressure set-point. The air pressure set-point itself is dependent on the current liquid flow rate as measured by the liquid flow meter 54.

The relationship between required air pressure and measured liquid flow rate depends on the process. In accordance with one embodiment of the invention, the required air pressure can be calculated based on the different gas inlet conditions. For implementing the invention, the required air pressure is calculated at various different inlet gas conditions. They are usually denoted by at least the following:

the minimum inlet gas conditions (which typically requires a minimum liquid flow rate);

the normal inlet gas conditions (which typically requires a normal liquid flow rate); and the maximum inlet gas conditions (which typically requires a maximum liquid flow rate).

The calculation of the air pressure depends on the required Dmax droplet size at the given conditions for having complete evaporation. As a result of these calculations, the controller 80 creates a table with three (or more) liquid flow rate values and their corresponding air pressure values. The control system uses this table for calculating the required air pressure (using interpolation between the table points).

In accordance with one preferred implementation of the invention, the following Table I is constructed in accordance with the various calculations employed by the control system:

TABLE I

| | Inlet Gas Flow Rate ($Nm^3$/hr) | Inlet Gas Temperature (° C.) | Required Dmax (μm) | Liquid Flow Rate (l/min) | Air Pressure (bar) |
|---|---|---|---|---|---|
| Minimum | 20000 | 280 | 120 | 12 | 2.5 |
| Normal | 25,000 | 300 | 110 | 19 | 3.5 |
| Maximum | 30,000 | 320 | 100 | 27 | 6.2 |

Figure 3:
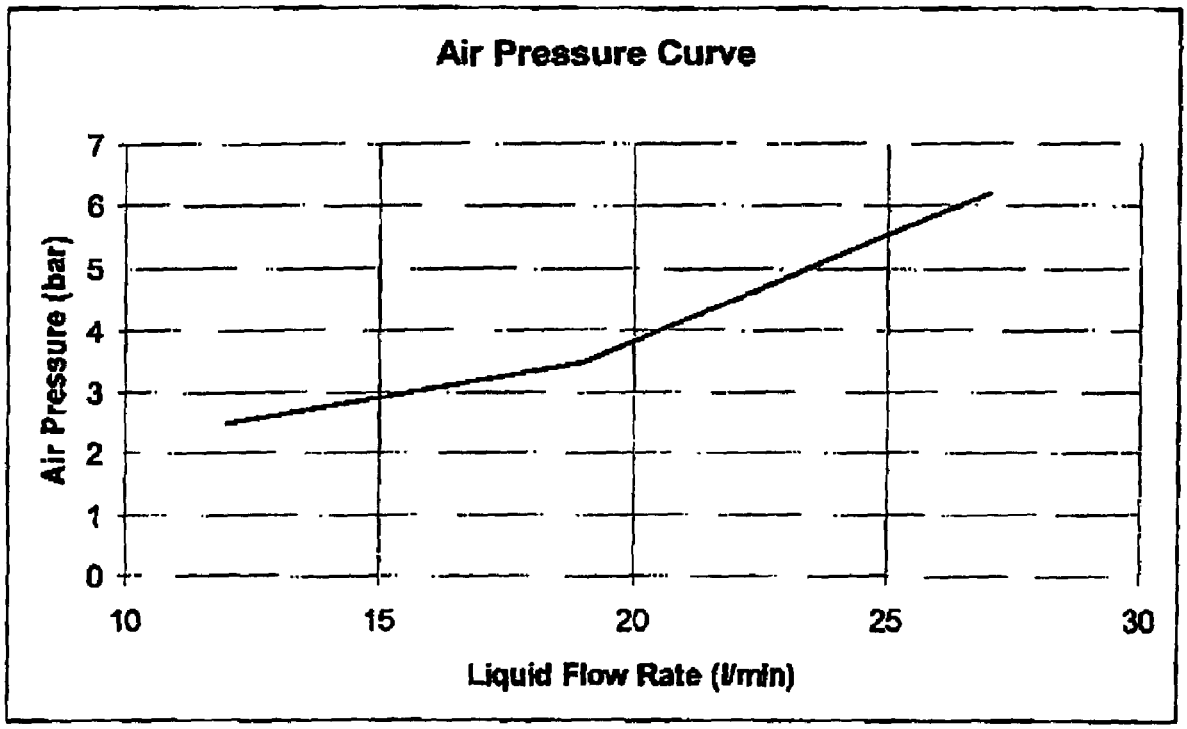
FIGS. 3 and 4 are graphs of liquid flow rate as a function of air pressure.

In this illustrative example, the controller 80 utilizes the shaded area in Table I above to calculate the desired air pressure that will be provided to the spray nozzle 20. In this way, the relationship between the liquid flow rate and the air pressure applied to the nozzle may be plotted in accordance with FIG. 3.

As shown, the worst-case operating condition with respect to required compressed air is located at the maximum liquid flow rate inasmuch as the maximum air pressure is required at this location. Thus, in prior art systems wherein the air pressure is maintained at a relatively constant value, the air pressure is required to be set to satisfy the worst-case condition. In the above-described example, the air pressure would be required to be maintained at approximately 6.2 bar.

In keeping with the invention, a substantial amount of compressed air can be saved when the supplied air pressure is adapted to correspond to the current liquid flow rate requirements and conditions. In other words, when the liquid flow rate is operating at approximately 12 liters/minute, the system may reduce the amount of compressed air to approximately 2.5 bar. On the other hand, when the liquid flow rate is operating at normal conditions, which corresponds to approximately 19 liters/minute in Table I, the amount of compressed air may be adjusted to approximately 3.5 bar. As noted above, the control system uses interpolation to plot the various operating conditions that fall between these values.

Figure 4:
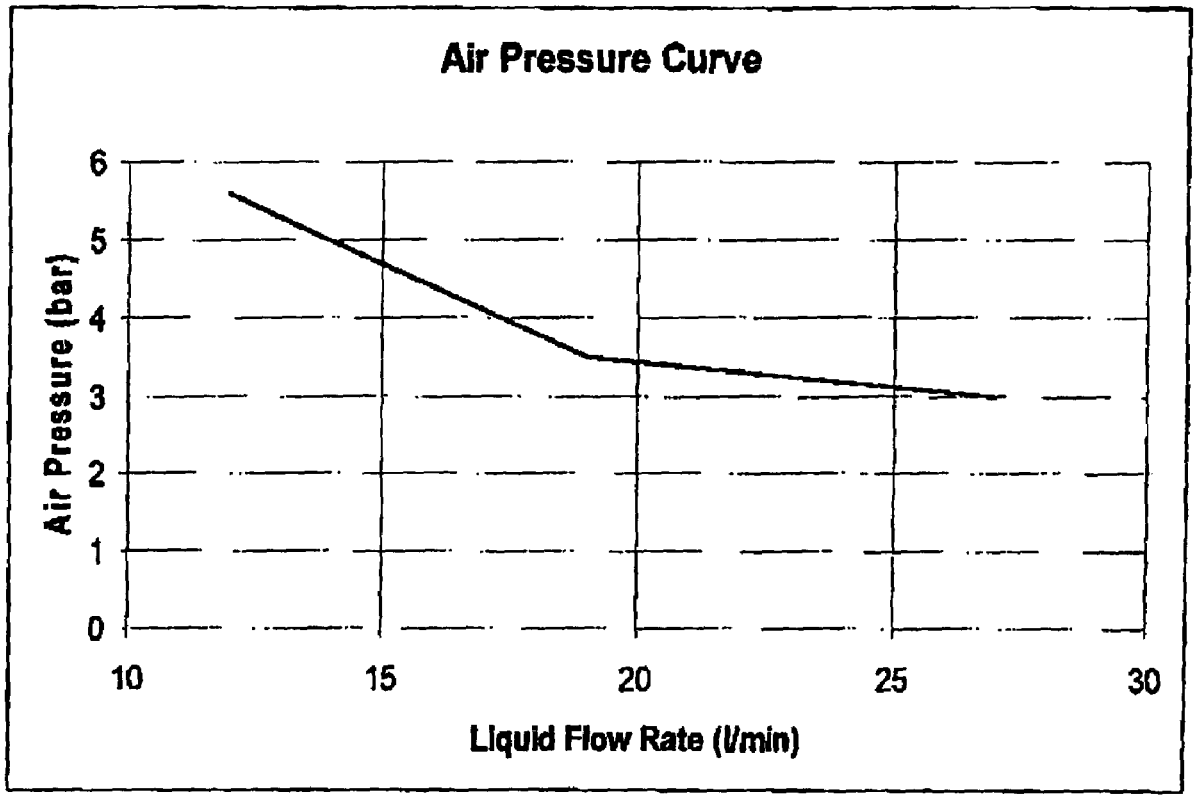

In certain instances, the worst-case condition for compressed air requirements may be located at a diminished liquid flow rate, as shown in FIG. 4.

In this example, a substantial amount of compressed air that is applied to the system may be saved in comparison to prior art control systems that employed constant air pressure schemes. That is, as the liquid flow rate is increased, such as to a flow rate of 25 liters per minute, the required air pressure may be reduced to slightly more than 3 bar. On the other hand, when a diminished liquid flow rate is detected, such as approximately 12 liters per minute, the amount of compressed air may be increased, in this example to approximately 5.5 bar.

Figure 5:
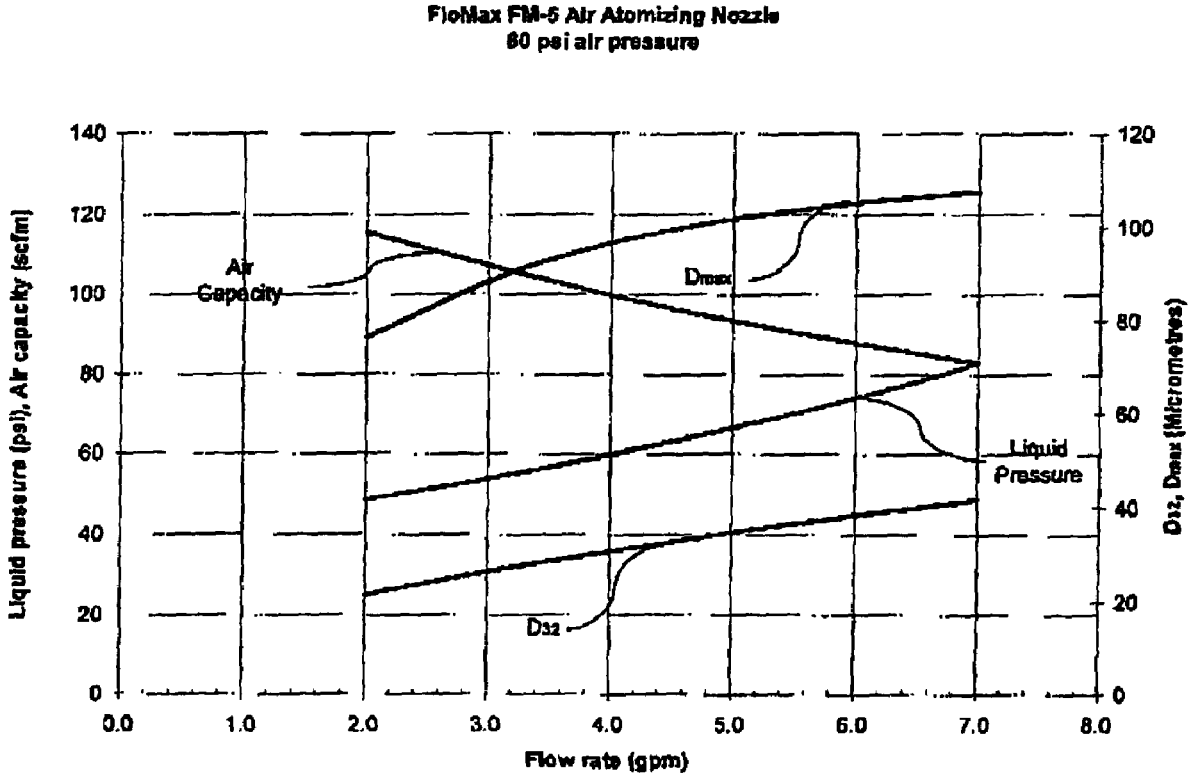
FIG. 5 is a graph showing the relationship between flow rate and liquid pressure, air capacity, and drop size.

The potential savings of compressed air can be further explained from the graph of FIG. 5 for a typical spray nozzle utilized in the preferred implementation of the invention. In this instance, the spray nozzle is a FloMax nozzle manufactured by the assignee of the present invention.

FIG. 5 illustrates the performance values of a type FM5 FloMax nozzle, manufactured by Spraying Systems Co., operating at a constant air pressure of 60 pounds per square inch. From the graph, the air-flow rate increases when the liquid flow rate goes decreases (e.g., at 7 GPM liquid, the nozzle needs 83 scfm air, while at 2 GPM liquid the nozzle needs 115 scfm air). At the same time, the Dmax also tends to decrease. On the other hand, at lower liquid flow rate conditions, a lower Dmax is usually not required. Accordingly, the air pressure can be decreased. This results in less air consumption by the system.

Accordingly, a control system for reducing the amount of compressed air consumed by the system that meets the aforestated objectives has been described. It should be understood, however, that the foregoing description has been limited to the presently contemplated best mode for practicing the invention. It will be apparent that various modifications may be made to the invention, and that some or all of the advantages of the invention may be obtained. Also, the invention is not intended to require each of the above-described features and aspects or combinations thereof, since in many instances, certain features and aspects are not essential for practicing other features and aspects. Accordingly, the invention should only be limited by the appended claims and equivalents thereof, which claims are intended to cover such other variations and modifications as come within the true spirit and scope of the invention.

What is claimed is:

1. A control system for controlling the compressed air applied to one or more spray nozzles used in a flue gas cooling system wherein the one or more nozzles are of the type that operate to receive pressurized liquid and pressurized air and to provide an atomized liquid oriented at the flue gas to thereby cool the same, comprising:

a liquid supply line coupled with the one or more spray nozzles including a flow meter disposed therein for sensing a flow rate of liquid supplied to the one or more spray nozzles;

a compressed air supply line including an air flow valve disposed to adjust the amount of compressed air supplied to the one or more spray nozzles; and a spray controller coupled with the flow meter and the air flow valve, the controller operable in accordance with an algorithm based on flue gas flow and temperature characteristics at various operating conditions to provide a control signal to the air flow valve to adjust the amount of compressed air being supplied to the one or more nozzles as a function of sensed liquid flow rate;

an adjustable liquid flow valve disposed in the liquid spray supply line disposed to receive a control signal from the controller to adjust the amount of liquid supplied to the one or more spray nozzles; and a temperature sensor located in proximate relation to the flue gases and disposed to provide a temperature sensing signal to the controller, wherein the spray controller having means for calculating, in response to receipt of the temperature sensing signal, a desired valve position for the liquid flow valve as, $$m = K_p \cdot \left( e + \frac{1}{K_i} \cdot \int e\,dt + K_d \cdot \frac{de}{dt} \right),$$

with m being the desired valve position of the liquid flow valve, e being a difference between a measured temperature indicated by the temperature sensing signal and a set-point temperature, and Kp, Ki and Kd being proportional, integral and differential factors, respectively, and supplying a control signal to the liquid flow valve to adjust the liquid flow valve to the desired valve position to cause a change in a liquid flow rate through the liquid flow valve.

2. The invention of claim 1, wherein the controller includes means for calculating a desired air pressure based on a sensed liquid flow rate through the liquid flow valve and a table specifying a relationship between liquid flow rate and air pressure for the one or more spray nozzles.

3. The invention as in claim 1 wherein the controller includes means for providing a signal to the liquid flow valve to increase the liquid flow supplied to the one or more nozzles when an increase in temperature is sensed.

4. The invention as in claim 3 wherein the controller includes means for providing a signal to the liquid flow valve to decrease the liquid flow supplied to the one or more nozzles when a decrease in temperature is sensed.

5. A method for controlling the amount of compressed air applied to one or more spray nozzles of the type used in various operable modes of a flue gas cooling system in the cooling of flue gas&-generated by the system and that is operative to receive pressurized liquid and pressurized air and to supply an atomized liquid spray, comprising the steps of:

detecting a measured temperature of the flue gas;

calculating a desired valve position for a liquid flow valve supplying liquid to the one or more spray nozzles as:

$$m = K_p \cdot \left( e + \frac{1}{K_i} \cdot \int e\,dt + K_d \cdot \frac{de}{dt} \right),$$

with m being the desired valve position of the liquid flow valve, e being a difference between the measured temperature and a set-point temperature, and Kp, Ki and Kd being proportional, integral and differential factors, respectively;

adjusting the liquid flow valve to the desired valve position to cause a change in a liquid flow rate through the liquid flow valve;

monitoring an actual liquid flow rate being applied to the one or more spray nozzles; and adjusting the compressed air supply as a function of the applied liquid flow rate.

6. The invention as in claim 5, wherein the step of adjusting the compressed air supply includes calculating a desired air pressure based on the applied liquid flow rate and a table specifying a relationship between liquid flow rate and air pressure for the one or more spray nozzles, and adjusting the compressed air supply to achieve the desired air pressure.

* * * * *